United States Patent [19]

Simons et al.

[11] Patent Number: 5,072,792

[45] Date of Patent: Dec. 17, 1991

[54] CONCEALED SPRINKLER HEAD ASSEMBLY

[75] Inventors: John R. Simons, Greendale; William Galaszewski, Brookfield, both of Wis.

[73] Assignee: Star Sprinkler Corporation, Milwaukee, Wis.

[21] Appl. No.: 337,469

[22] Filed: Apr. 13, 1989

[51] Int. Cl.[5] ..... A62C 37/08

[52] U.S. Cl. ..... 169/37; 169/40; 169/42

[58] Field of Search ..... 169/37, 40, 41, 90, 169/42; 248/343, 344

[56] References Cited

U.S. PATENT DOCUMENTS

| | | | |
|---|---|---|---|
| 2,389,331 | 11/1945 | Tyden | 169/37 |
| 3,389,884 | 6/1968 | Ault | 169/37 |
| 3,998,273 | 12/1976 | Juliano | 169/37 |
| 4,014,388 | 3/1977 | Anderson | 169/37 |
| 4,015,665 | 4/1977 | Simons et al. | 169/40 |
| 4,066,129 | 1/1978 | Anderson | 169/37 |
| 4,105,076 | 8/1978 | Simons et al. | 169/40 |
| 4,376,465 | 3/1983 | Simons et al. | 169/39 |
| 4,491,182 | 1/1985 | Pieczykolan | 169/38 |
| 4,508,175 | 4/1985 | Pieczykolan | 169/38 |
| 4,618,002 | 10/1986 | Mears | 169/37 |
| 4,662,455 | 5/1987 | Simons | 169/37 |
| 4,757,865 | 7/1988 | Simons | 169/39 |
| 4,766,961 | 8/1988 | Macie | 169/38 |
| 4,926,946 | 5/1990 | Polan | 169/37 |

*Primary Examiner*—Joseph F. Peters, Jr.
*Assistant Examiner*—Christopher P. Ellis
*Attorney, Agent, or Firm*—Andrus, Sceales, Starke & Sawall

[57] ABSTRACT

An improved concealed sprinkler head assembly that incorporates a standard pendant-type sprinkler head includes a frame having an outlet that is connected to a water line and a valve cap that encloses the outlet and is held in the closed position by a releasable lever mechanism which includes a fusible metal. The assembly also includes a pre-assembled cover plate unit that consists of a disc having a central opening that is slid upwardly over the frame of the sprinkler head. The cover plate unit also includes a tubular sleeve having a pair of opposed notches which receive projections on the periphery of the disc. A decorative cover plate is secured through a fusible metal, such as solder, to the lower edge of the sleeve, and a coil spring, in a compressed condition, interconnects the upper end of the sleeve with the disc.

13 Claims, 2 Drawing Sheets

FIG. 1
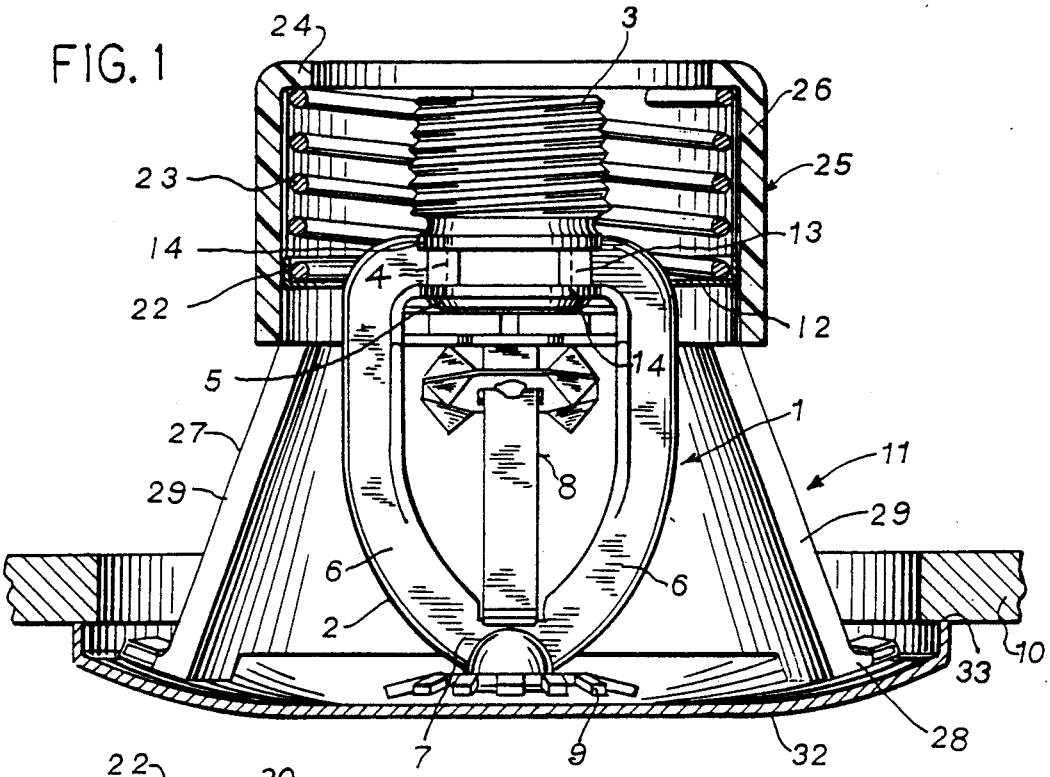
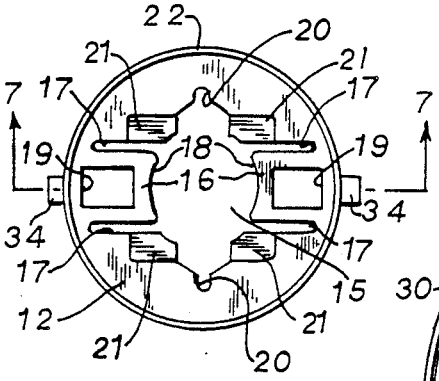
FIG. 6
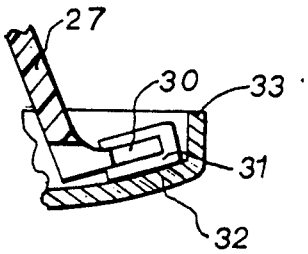
FIG. 5
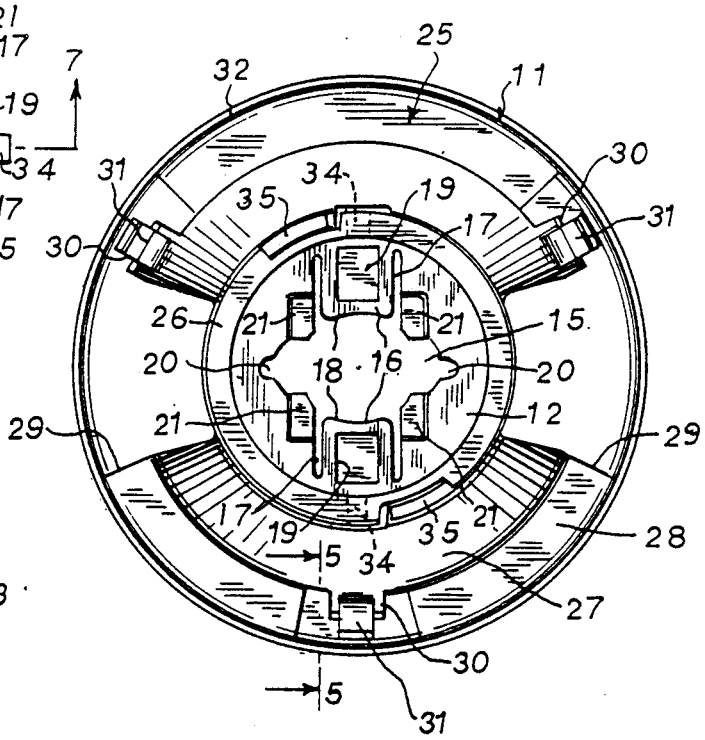
FIG. 2

FIG. 3
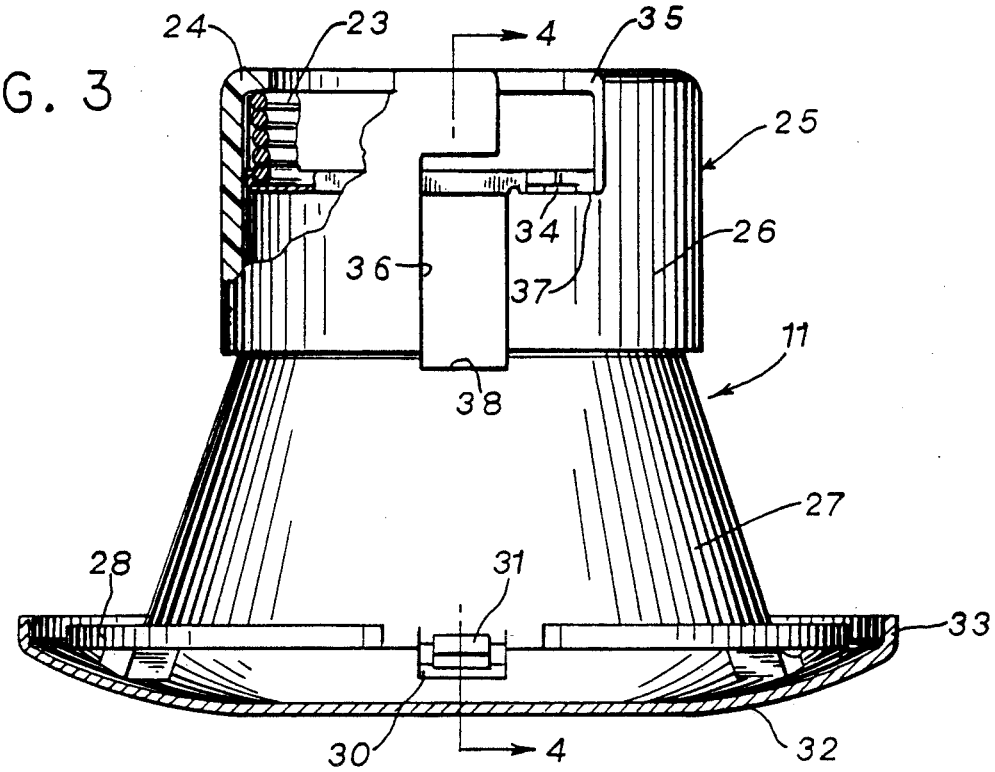
FIG. 4
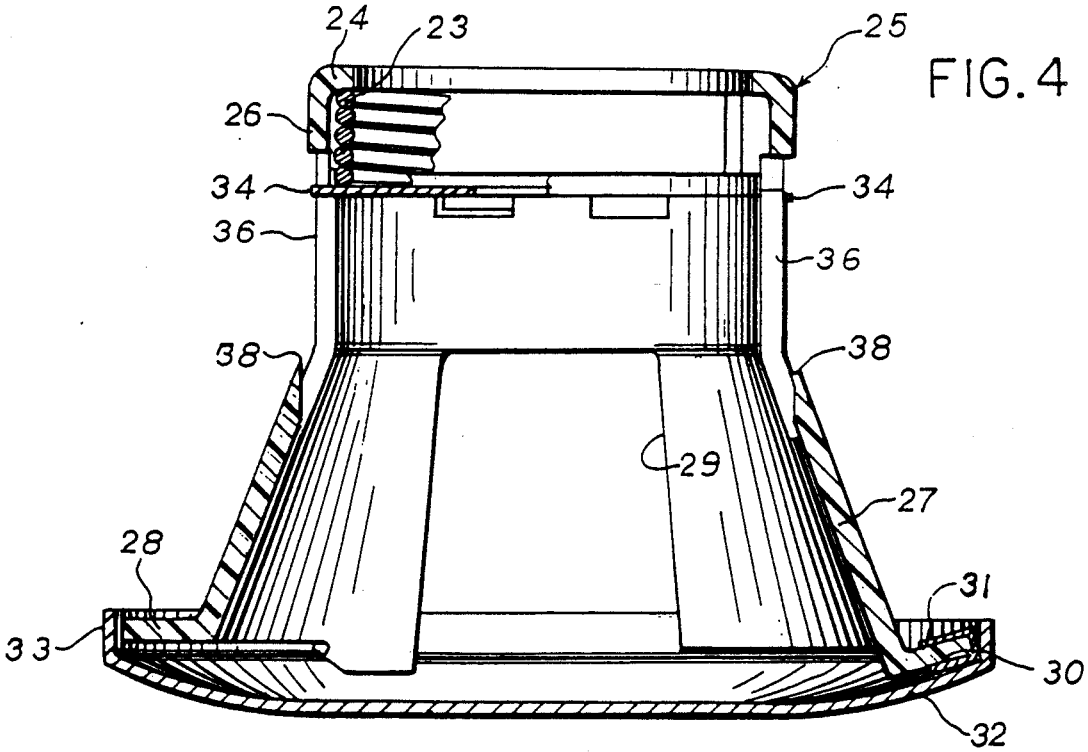
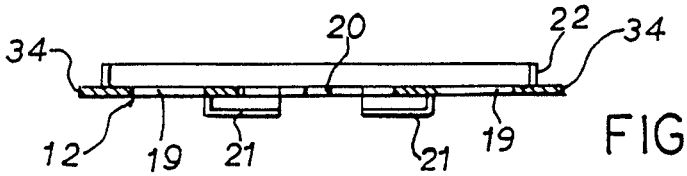
FIG. 7

CONCEALED SPRINKLER HEAD ASSEMBLY

BACKGROUND OF THE INVENTION

The conventional pendant type automatic sprinkler head includes a body or frame that has an outlet which is normally enclosed by a valve cap and the cap is held in the closed position by a releasable lever assembly which includes a low melting point fusible element. With a pendant-type sprinkler head, the lever assembly extends downwardly beneath the ceiling of the building, and when the temperature increases to a predetermined level, the fusible element will melt, releasing the lever assembly to open the outlet and discharge the water.

In residential dwellings and commercial buildings, it is often desired to utilize a sprinkler head that is located above the ceiling, so that the operative parts are not exposed to view. With this type of construction, the sprinkler head is concealed within the ceiling by a decorative plate that is mounted flush against the undersurface of the ceiling, so that the operative parts are not visible.. U.S. Pat. Nos. 3,633,676, 3,714,898 and 4,015,665 describe concealed sprinkler heads.

The conventional concealed sprinkler had includes a cylindrical sleeve or cup, which is secured around the cast metal frame or body. In the final assembly, and after testing of the sprinkler head for possible leaks, a decorative cover plate is attached to the sleeve and encloses the sprinkler head as well as the opening in the ceiling. In normal practice, the sleeve is preassembled in the factory with the frame. At the location of use, the sprinkler head, along with the attached sleeve, is installed with the water pipe line and after installation, the sprinkler head is tested for possible leakage. Because of the presence of the cylindrical sleeve, small leakage at the threaded joint may not be readily visible, with the result that the time required for the pressure testing procedure is substantially increased.

In order to properly position the cover plate of the concealed sprinkler head with respect to a suspended ceiling, the body or frame of the sprinkler head must be installed a precise distance from the lower surface of the ceiling. Concealed sprinkler heads, as used in the past, have had minimum provisions for adjustment, with the result that if the critical distance between the body and the ceiling is not maintained, the cover plate would not be positioned flush with the ceiling, thereby resulting in an unsightly gap.

SUMMARY OF THE INVENTION

The invention is directed to a concealed sprinkler head assembly which utilizes a conventional pendant sprinkler head. The pendant sprinkler head includes a metal frame having a base that defines an outlet which is connected to a water line. The frame also comprises a pair of arms which extend downwardly from the base and are joined together at a junction. A valve cap normally encloses the outlet in the frame and a releasable lever mechanism interconnects the junction and the valve cap. The lever mechanism includes a fusible metal, such as solder, and when the lever mechanism is exposed to a predetermined elevated temperature, the solder will melt to release the lever mechanism and open the valve cap.

After the sprinkler head has been installed with the water line and tested for possible leakage, a preassembled cover plate unit is installed with the sprinkler head.

The cover plate unit includes a disc having a central opening which can be slipped upwardly over the sprinkler head and the disc is provided with a pair of opposed flexible tabs which engage a circumferential groove in the frame adjacent the outlet.

The disc is also provided with a pair of outwardly extending projections which are received within peripheral notches in the upper end of a tubular sleeve and the lower peripheral edge of the sleeve is connected via a fusible metal, such as solder, to a cover plate. Interconnecting the upper end of the sleeve and the disc is a compression spring which acts to bias the projections on the disc into engagement with the bases of the notches in the sleeve.

The pre-assembled cover plate unit is slipped upwardly over the sprinkler head to engage the tabs on the disc with the groove in the frame. The sleeve and cover plate are then rotated relative to the disc which brings the projections on the disc into registry with elongated slots formed in the sleeve. With the projections in registry with the slots, the force of the spring will then urge the sleeve and cover plate upwardly relative to the disc, which is attached to the frame, thus urging the cover plate into tight engagement with the undersurface of the ceiling.

With the concealed sprinkler head assembly of the invention, a standard pendant sprinkler head can be utilized, thus eliminating the tooling cost and inventory for a separate head to be used with a concealed sprinkler.

The invention provides a full, solid cover plate which completely encloses the opening in the ceiling, thus providing a more aesthetic appearance for the unit.

As a further advantage, the sprinkler head is attached to the water line and is tested for possible leakage before the sleeve is installed with the sprinkler head. Thus, the testing procedure can be carried out without the sleeve in position, so that small leakage through the threaded joint is readily visible.

As the cover plate is biased upwardly by the compression spring, the cover plate will be maintained in tight engagement with the ceiling at all times. Over a period of time, the vertical distance between the water line and the lower surface of a ceiling of a building may vary slightly. The sprinkler head assembly of the invention provides an automatic floating action which enables the cover plate to float up to one-half inch to accommodate this variation in vertical distance.

The cover plate unit can be installed more quickly than conventional types by merely sliding the sleeve upwardly and then twisting the sleeve through a short arc. This substantially increases the speed of assembly as compared to conventional types in which the cover plate assembly is threaded onto the sprinkler head.

The sleeve is preferably formed of a non-metalic material, such as plastic, and because of this a faster response for release of the cover plate is achieved, for the sleeve will not serve as a metal heat sink as in conventional concealed sprinkler heads.

Other objects and advantages will appear in the course of the following description.

DESCRIPTION OF THE DRAWINGS

The drawings illustrate the best mode presently contemplated of carrying out the invention.

In the drawings:

FIG. 1 is a longitudinal section of the sprinkler head assembly of the invention;

FIG. 2 is a top view of the pre-assembled cover plate unit;

FIG. 3 is a side view of the cover plate unit with parts broken away in section;

FIG. 4 is a section taken along line 4—4 of FIG. 3;

FIG. 5 is a fragmentary section taken along line 5—5 of FIG. 2;

FIG. 6 is a plan view of the disc; and

FIG. 7 is a section taken along line 7-7 of FIG. 6.

DESCRIPTION OF THE ILLUSTRATED EMBODIMENT

The drawings illustrate a concealed automatic sprinkler head assembly comprising a pendant sprinkler head 1 that includes a cast metal frame 2 having an upper end 3 that is adapted to be threaded to a water line, not shown. The upper end of frame 2 defines an outlet 4, which is normally enclosed by a valve cap 5. Frame 2 also includes a pair of arms 6 and the lower ends of the arms are connected together at a junction 7.

Valve cap 5 is held in the closed position by a releasable lever assembly 8. Lever assembly 8, which, in itself, forms no part of the present invention, can be constructed as shown in U.S. Pat. No. 4,376,465. The lever assembly 8 includes a fusible metal or alloy and when the sprinkler head is subjected to a predetermined elevated temperature, the fusible material will melt to release the lever assembly, so that the water pressure in the water line will dislodge the valve cap 5 and permit the water to be discharged from the outlet. To deflect the water outwardly in the desired spray pattern, a deflector 9 is mounted on the lower portion of junction 7.

The assembly also includes a pre-assembled cover plate unit 11 that is mounted on the sprinkler head 1 after the sprinkler head has been attached to the water line and test for possible leakage. The cover plate unit 11 includes a generally circular metal disc 12 which is engaged with a circumferential groove 13 formed in the base 3 of frame 2. Groove 13 is bordered by a pair of spaced ribs 14 and the groove 13 is polygonal, preferably hexagonal, and is adapted to receive a wrench that is used to thread the sprinkler head 1 to the water line.

As shown in FIG. 6, disc 12 is provided with a central opening 15 having a configuration to receive the frame 2 and a pair of opposed flexible resilient tabs 16, each of which is defined by a pair of spaced parallel slits 17, border the opening 15. The inner edge 18 of each tab is engaged with the groove 13 as the pre-assembled unit 11 is slipped upwardly relative to the sprinkler head, to maintain the disc 12 in position on the sprinkler head.

To increase the flexibility of the tabs 16, each tab is provided with a hole or aperture 19.

Central opening 15 is also provided with a pair of opposed recesses 20 which receive the arms 6 of the frame as the disc is slipped upwardly over the sprinkler head, as will be hereinafter described. To prevent the tabs 16 from being moved upwardly beyond the groove 13 in frame 2, the disc is provided with a plurality of depressions 21 which border the central opening 15. As shown in FIG. 7, the depressions are disposed at a lower level than the remainder of the disc and will engage the frame 2 after the tabs 16 are received within groove 13 and thus serve as stops or locating means to prevent the tabs 16 from being pushed upwardly beyond groove 13.

Disc 12 is formed with an upwardly projecting peripheral flange 22 and a compression spring 23 is interposed between the disc 12 and an inwardly extending flange 24 on a tubular sleeve 25 that is spaced radially outward of sprinkler head 1.

As best shown in FIGS. 2-4, sleeve 25 is composed of a generally cylindrical upper section 26 and a lower frustoconical section 27, which flares outwardly from the lower end of upper cylindrical section 26. The lower edge of section 27 is formed with a peripheral flange 28.

Opposite portions of lower section 27 are provided with openings 29 which permit the circulation of air into the sleeve 25 to thereby improve the response rate to the fusible metal of lever assembly 8.

As illustrated in FIGS. 2 and 5, three feet 30 extend outwardly from the lower edge of section 27 and the feet are spaced circumferentially from flange 28. A metal U-shaped clip 31 is positioned on each foot 30 and a layer of a fusible metal or solder connects the lower leg of each clip 31 to the peripheral edge of a metal cover plate 32, as seen in FIG. 5. Cover plate 32 is provided with a peripheral edge 33 which engages the lower surface of ceiling 10. Cover plate 32 is a solid, continuous member and serves to enclose the opening in ceiling 10, as well as fully covering the operating elements of the sprinkler head 1.

The disc 12, sleeve 25, spring 23, clips 31, and cover plate 32 constitute the pre-assembled cover plate unit 11. Disc 12 includes a pair of outwardly extending opposed tabs 34, which are received in notches or slots 35 formed in the upper section 26 of sleeve 25. An elongated vertical slit or recess 36 is offset from each notch and communicates with the lower end of each notch 35. In the pre-assembled state, the tabs 34 are biased into engagement with the lower ends 37 of notches 35 by spring 23, as seen in FIG. 3. In this condition, spring 23 is compressed. Once the unit 11 is installed on the sprinkler head 1, sleeve 25 and cover plate 32 are rotated relative to disc 12, which at this time is fixed relative to frame 2, via the engagement of tabs 16 with the hexagonal groove 13 in the frame, thereby bringing the tabs 34 on disc 12 into registry with the elongated recesses 36 and the spring 23 will then expand and urge the sleeve 25 and cover plate 32 upwardly until the peripheral edge of the cover plate engages the lower surface of the ceiling. With cover plate 32 engaged with ceiling 10, the tabs 34 will normally be spaced above the bottoms 38 of recesses 36, so that in service the sleeve 25 and cover plate 32 can float both up and down to accommodate possible variations in height between the water line and ceiling 10.

To install the concealed sprinkler head assembly of the invention, the frame 2 is threaded onto the water line, so that the deflector 9 is at a specified distance relative to the lower surface of the ceiling 10. With the sprinkler head 1 attached to the water line, the system is then tested for possible leakage and as the sleeve 25 is not attached at this time, any leakage through the threaded joint is readily visible.

The pre-assembled unit 11 is then attached to the sprinkler head by sliding the disc 12 upwardly over the frame 2 until the tabs 16 engage the groove 13 in frame 2. Engagement of tabs 16 with the hexagonal groove 13 will prevent rotation of disc 12 relative to frame 2. At this time, the tabs 34 on disc 12 are engaged with the lower edge 37 of notch 35, so that the spring 23 is in a compressed condition. Sleeve 25, along with the attached cover plate 32, is then rotated relative to disc 12 to bring the tabs 34 into registry with the elongated recesses 36. Spring 23 will then expand, urging the cover plate 32 upwardly until the peripheral edge of the cover plate engages the lower surface of the ceiling.

The invention incorporates a standard pendant-type sprinkler head and thus the same sprinkler head can be employed for both pendant, as well as concealed installations. This substantially reduces inventory and tooling costs.

The concealed sprinkler head of the invention also enables the cover plate 32 to float with possible changes in vertical spacing between the water line and the ceiling. The spring 23 which interconnects the sleeve 25 and disc 12 will expand and compress to accommodate this change in dimension.

The invention can also be more rapidly installed as compared to conventional concealed sprinkler heads. The pre-assembled unit 11 is merely slid upwardly over sprinkler head 1 to engage the tabs 16 of disc 12 with groove 13. The sleeve and cover plate are then rotated through a small arc to complete the assembly. Further, no special tools are required for attaching the sleeve and cover plate to the sprinkler head.

The sprinkler head of the invention also provides a faster release in that the sleeve 25 is preferably formed of a non-metallic material, such as plastic, so that it will not function as a heat sink to transfer heat away from the fusible metal which connects the cover plate 32 to the feet 30 on sleeve 25. When the assembly is exposed to a predetermined elevated temperature, the fusible metal connecting cover plate 32 to feet 30 will intially melt, enabling the cover plate to fall from the ceiling. Heated air can then flow into the lower end of sleeve 25, as well as through openings 29, to heat and melt the fusible metal of lever assembly 8, thereby releasing the lever assembly and opening the valve cap 5. The water will then be discharged through the outlet 4 and be deflected outwardly by deflector 9 in the desired spray pattern.

Various modes of carrying out the invention are contemplated as being within the scope of the following claims particularly pointing out and distinctly claiming the subject matter which is regarded as the invention.

I claim:

1. In a concealed sprinkler head assembly, a frame having an outlet to be connected to a water line, valve cap means to enclose said outlet, releaseable means interconnecting the frame and said valve cap means for releasing said valve cap means when said releaseable means is exposed to a predetermined elevated temperature, the improvement comprising, a pre-assembled cover plate unit attached to said frame, said unit including connecting means to engage said frame as said unit is moved upwardly relative to said frame, a generally tubular sleeve connected to said connecting means and disposed radially outward of said connecting means, a cover plate, fusible means interconnecting the lower end of the sleeve and the cover plate, biasing means interposed between said connecting means and said sleeve, first means interconnecting the sleeve and said connecting means for maintaining the biasing means in a compressed condition as said unit is assembled with said frame, said first means being operable as a consequence of relative rotation between the sleeve and said connecting means for releasing the biasing means from said compressed condition to urge said sleeve and said cover plate upwardly relative to said connecting means to bring said cover plate into engagement with the lower surface of a ceiling of a building.

2. The assembly of claim 1, wherein said frame is mounted generally above the lower surface of the ceiling.

3. The assembly of claim 1, wherein said first means comprises an abutment on said connecting means and engaged with a first surface on said sleeve.

4. The assembly of claim 3, wherein said sleeve has an elongated recess offset circumferentially and extending downwardly from said first surface, relative rotation between said sleeve and said connecting means effecting movement of said abutment from said first surface to said recess.

5. The assembly of claim 1, wherein the lower edge of the sleeve is provided with an outwardly extending flange, said fusible means interconnecting said flange and the cover plate.

6. The assembly of claim 5, wherein said sleeve is composed of non-metallic material, and said assembly includes a U-shaped metal clip disposed in engagement with said flange, said fusible means connecting said clip to said cover plate.

7. The assembly of claim 1, wherein said sleeve includes a side wall, said side wall having an opening therein for the circulation of gas.

8. The assembly of claim 7, wherein said sleeve is provided with an upper cylindrical section and a lower frustoconical section tapering downwardly and outwardly from the lower end of said cylindrical section.

9. The assembly of claim 1, wherein said connecting means comprises a disc having a central opening to receive said frame, said disc having a pair of opposed flexible tabs bordering the opening and disposed to engage an abutment on said frame to position said disc relative to said frame.

10. The assembly of claim 9, wherein said frame is provided with a circumferential groove and said tabs are engaged with said groove.

11. The assembly of claim 10, and including locating means for preventing said disc from moving upwardly on said frame beyond said groove.

12. The assembly of claim 11, wherein said locating means comprises a member disposed at a level beneath said tabs and disposed to engage an abutment on said frame.

13. The assembly of claim 1, wherein said biasing means comprises a compression spring.

* * * * *